US005885062A

United States Patent [19]

Inoue et al.

[11] Patent Number: 5,885,062

[45] Date of Patent: Mar. 23, 1999

[54] SWITCHING VALVE FLUID COMPRESSOR AND HEAT PUMP TYPE REFRIGERATION SYSTEM

[75] Inventors: Toshinobu Inoue, Numazu; Masao Ozu, Fuji; Masumi Hasegawa, Fuji; Kazuhiko Miura, Fuji, all of Japan

[73] Assignee: Kabushiki Kaisha Toshiba, Kawasaki, Japan

[21] Appl. No.: 799,460

[22] Filed: Feb. 13, 1997

[30] Foreign Application Priority Data

Jun. 19, 1996 [JP] Japan ..... 8-158383

[51] Int. Cl.[6] ..... F04B 49/02; A23G 9/00

[52] U.S. Cl. ..... 417/280; 417/282; 417/410.3; 62/342.6; 137/625.43; 251/160; 251/175

[58] Field of Search ..... 62/342.6, 224.1; 417/280, 282, 294, 316, 410.3, 410.1; 137/625.43, 625.46; 251/160, 175

[56] References Cited

U.S. PATENT DOCUMENTS

| | | | |
|---|---|---|---|
| 3,371,502 | 3/1968 | Heidorn | 62/324.6 |
| 4,474,030 | 10/1984 | Ladusaw | 62/324.1 |
| 4,702,088 | 10/1987 | Ozu | 62/324.1 |
| 5,507,315 | 4/1996 | Parker | 137/625.43 |
| 5,547,344 | 8/1996 | Sugiyama et al. | 62/324.1 |

FOREIGN PATENT DOCUMENTS

| | | |
|---|---|---|
| 60-124595 | 8/1985 | Japan . |
| 4-7409 | 2/1992 | Japan . |
| 4-47155 | 8/1992 | Japan . |
| 5-41911 | 6/1993 | Japan . |

*Primary Examiner*—Charles G. Freay
*Attorney, Agent, or Firm*—Pillsbury Madison & Sutro LLP

[57] ABSTRACT

A switching valve comprises a valve body to which a plurality of fluid passages are connected, a slider having a gas passage capable of selectively connecting two fluid passages, a balance port for letting the gas passage communicate with the outside of the slider, a pilot valve for opening and closing the balance port, a moving mechanism for moving the pilot valve and the slider as one body in a predetermined direction alone, and a forwardly and reversely rotatable motor unit for driving the slider to open the balance port, thereby canceling a pressure difference between the inside and outside of the slider and then moving the slider to switch the fluid passages.

28 Claims, 11 Drawing Sheets

(FORWARD ROTATION)
POSITION L (REVERSE ROTATION)

POSITION H (FORWARD ROTATION)

SWITCHING VALVE FLUID COMPRESSOR AND HEAT PUMP TYPE REFRIGERATION SYSTEM

BACKGROUND OF THE INVENTION

The present invention relates to a switching valve for switching a fluid passage, a fluid compressor with a casing containing the switching valve, and a heat pump type refrigeration cycle including the fluid compressor.

In an air-conditioning apparatus having a heat pump type refrigeration cycle in which a cooling drive mode and a heating drive mode can be easily switched, the switching of the drive mode is effected by changing the direction of passage of a fluid or a refrigerant gas.

In the prior art, the passage of refrigerant gas is changed by means of a four-way valve provided in the refrigeration cycle. The four-way valve comprises one inlet portion provided in the valve casing and three outlet portions linearly arranged on the side opposite to the inlet side. Two of the three outlet portions are always closed by the valve body.

The valve body is driven by an electromagnetic coil and moved in the valve casing. In accordance with signals supplied to the electromagnetic coil, the amount of movement and the direction of movement are changed. Thus, the output portion to be opened is changed. Specifically, a refrigerant gas introduced into the valve casing through the inlet portion is discharged from the outlet portion determined by the position of the valve body, and thus the passage of flow is switched.

Although the flow passage can be quickly switched by means of the four-way valve, the four-way valve has the following shortcomings:

1) Since the piping for constituting the refrigeration cycle is complicated, a large space is needed for the piping, and the size of the air-conditioning apparatus itself cannot be reduced.
2) Since the four-way valve has complex construction, an internal leak occurs, resulting in a decrease in performance, higher possibility of fault, and an increase in cost.
3) Since power is constantly supplied to the electromagnetic coil for driving the valve body, the power consumption increases.

In order to obviate these shortcomings, a system has been proposed, wherein a four-way valve is contained in the casing of the fluid compressor constituting a part of the refrigeration cycle and the four-way valve is switched by an electromagnetic drive actuator.

In the case of the fluid compressor, however, an actuator is contained in the casing body and power terminals are required. Consequently, the size of the compressor inevitably increases and the cost increases.

Furthermore, forcible gas balancing means for use in switching the four-way valve is not provided. Consequently, it is necessary to wait for the coming of a gas balance state after the system is stopped. Then, the force acting on the valve has decreased, the valve must be opened/closed.

Normally, it takes several minutes to wait for the coming of the gas balance state. For example, when the heating mode is switched to the defrosting mode, the time for defrosting increases. As a result, the heating performance decreases and the comfortability lowers.

BRIEF SUMMARY OF THE INVENTION

The present invention has been made in consideration of the above circumstances, and a first object of the invention is to provide a highly reliable switching valve for switching fluid passages, with a simple structure and a less internal leak.

A second object of the invention is to provide a fluid compressor containing the switching valve for switching fluid passages, wherein torque generating means for driving the switching valve need not be provided separately, resulting in a decrease in number of parts and enhancement in compression performance.

A third object of the invention is to provide a heat pump type refrigeration cycle having the fluid compressor for effecting switching between a cooling mode and a heating mode and between a heating mode and a defrosting mode, wherein a time for switching operation is reduced, comfortable air conditioning is maintained, piping of the refrigeration cycle is simplified, and the space for piping is reduced.

According to a first aspect of the present invention, there is provided a switching valve comprising:

a valve body to which a plurality of fluid passages are connected;

a slider having a gas passage capable of selectively connecting two of said plurality of fluid passages connected to the valve body;

a balance port formed in said slider to let said gas passage communicate with the outside of the slider;

a pilot valve for opening and closing said balance port;

a moving mechanism for moving said pilot valve and said slider as one body in a predetermined direction alone; and forwardly and reversely rotatable driving means for driving said pilot valve, along with said moving mechanism, to open said balance port, thereby canceling a pressure difference between the inside and outside of the slider, and then moving the slider to switch said fluid passages.

According to a second aspect of the invention, there is provided a fluid compressor comprising:

a casing body to which a plurality of fluid passages are connected;

a compressor mechanism unit contained in said casing body;

a motor unit contained in said casing body and comprising a stator and a rotor; and a switching valve, contained in said casing body, for switching said fluid passages, said switching valve comprising:

a valve body to which said plurality of fluid passages are connected;

a slider having a gas passage capable of selectively connecting two of said plurality of fluid passages connected to the valve body;

a balance port formed in said slider to let said gas passage communicate with the outside of the slider;

a pilot valve for opening and closing said balance port;

a moving mechanism for moving said pilot valve and said slider as one body in a predetermined direction alone; and forwardly and reversely rotatable driving means for driving said pilot valve, along with said moving mechanism, to open said balance port, thereby canceling a pressure difference between the inside and outside of the slider, and then moving the slider to switch said fluid passages.

According to a third aspect of the invention, there is provided a fluid compressor comprising:

a casing body to which a plurality of fluid passages are connected;

a motor unit including a compressor mechanism unit, a stator and a rotor all contained in said casing body;

a switching valve, contained in said casing body and connected to said fluid passages, for selectively connecting two of said plurality of fluid passages; and magnetic coupling means, provided between said switching valve and said motor unit, for magnetically coupling the switching valve and the motor unit, thereby transmitting a driving force of the motor unit to the switching valve.

According to a fourth aspect of the invention, there is provided a heat pump type refrigeration cycle comprising:

a fluid compressor for compressing a fluid;

a switching valve for switching fluid passages in said fluid compressor for flowing a non-compressed low-pressure fluid and a compressed high-pressure fluid;

an indoor heat exchanger and an outdoor heat exchanger connected to said switching valve via pipes; and a restriction device provided between the indoor heat exchanger and the outdoor heat exchanger, said switching valve comprising:

a valve body to which a plurality of fluid passages are connected;

a slider having a gas passage capable of selectively connecting two of said plurality of fluid passages connected to the valve body;

a balance port formed in said slider to let said gas passage communicate with the outside of the slider;

a pilot valve for opening and closing said balance port;

a moving mechanism for moving said pilot valve and said slider as one body in a predetermined direction alone; and forwardly and reversely rotatable driving means for driving said pilot valve, along with said moving mechanism, to open said balance port, thereby canceling a pressure difference between the inside and outside of the slider, and then moving the slider to switch said fluid passages.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

A first embodiment of the present invention will now be described with reference to the accompanying drawings.

Figure 1:
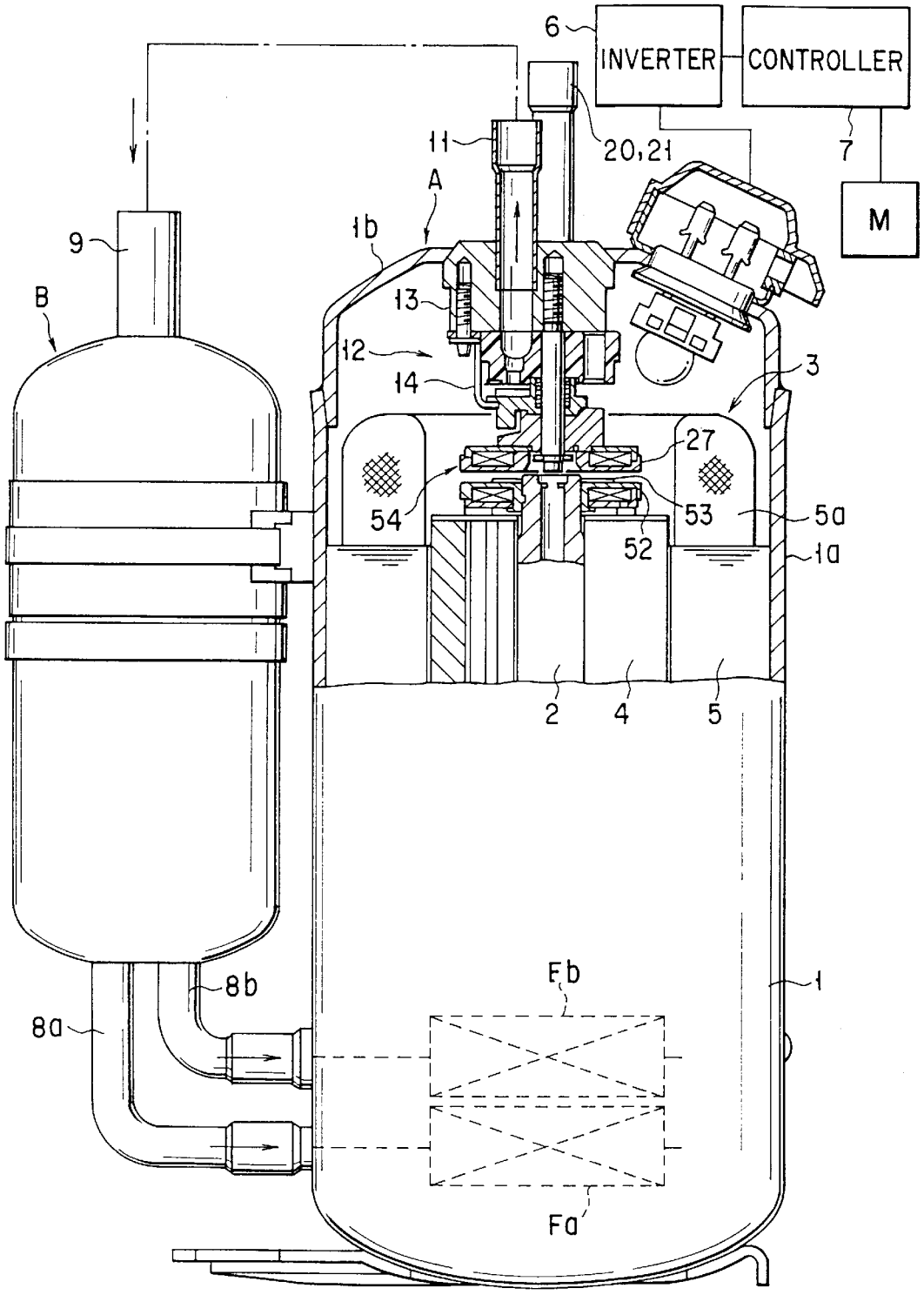
FIG. 1 is a vertical cross-sectional view showing a fluid compressor according to a first embodiment of the invention, with some parts being omitted.

FIG. 1 shows a fluid compressor A and an accumulator B.

The fluid compressor A has a casing body or a sealed casing 1. The sealed casing 1 comprises a main casing portion 1*a* with an opening on its upper side and an upper casing portion 1*b* closing the opening of the main casing portion 1*a*.

A rotary shaft 2 is supported vertically and rotatably within the sealed casing 1. An upper portion of the rotary shaft 2 is provided with a motor unit 3, and a lower portion of the rotary shaft 2 is provided with compressor mechanism units Fa and Fb (shown schematically).

The motor unit 3 comprises a rotor 4 fitted on the rotary shaft 2, and a stator 5 fitted on the main casing portion 1*a*, with a gap provided between the outer peripheral surface of the rotor 4 and the stator 5.

The motor unit 3 is electrically connected to an inverter 6. The inverter 6 is supplied with control signals from a controller 7 to control the number of rotations and the direction (forward or reverse) of rotations of the compressor mechanism units Fa and Fb.

The compressor mechanism units Fa and Fb are of any type. For example, the compressor mechanism units Fa and Fb may be of a regular reciprocal type, a rotary type, or a so-called scroll type.

The compressor mechanism units Fa and Fb are provided with cylinders (not shown). Suction portions of the cylinders communicate directly with suction pipes 8*a* and 8*b* extending from the accumulator B.

Discharge portions of the compressor mechanism units Fa and Fb are opened to the inside of the sealed casing 1. A low-pressure refrigerant gas sucked into the cylinders of the compressor mechanism units from the accumulator B is compressed, and a high-pressure refrigerant gas thus produced is discharged to the inside of the sealed casing 1. The compressor A is of a so-called "intra-casing high pressure" type.

A communication pipe 9 connected to an upper end portion of the accumulator B is connected to an S-pipe 11 (to be described later) extending from the fluid compressor A.

A switching valve 12 is disposed within the sealed casing 1. The switching valve 12 is situated in a space defined between the upper end surface of the motor unit 3 and the upper casing portion 1*b*.

Figure 2:
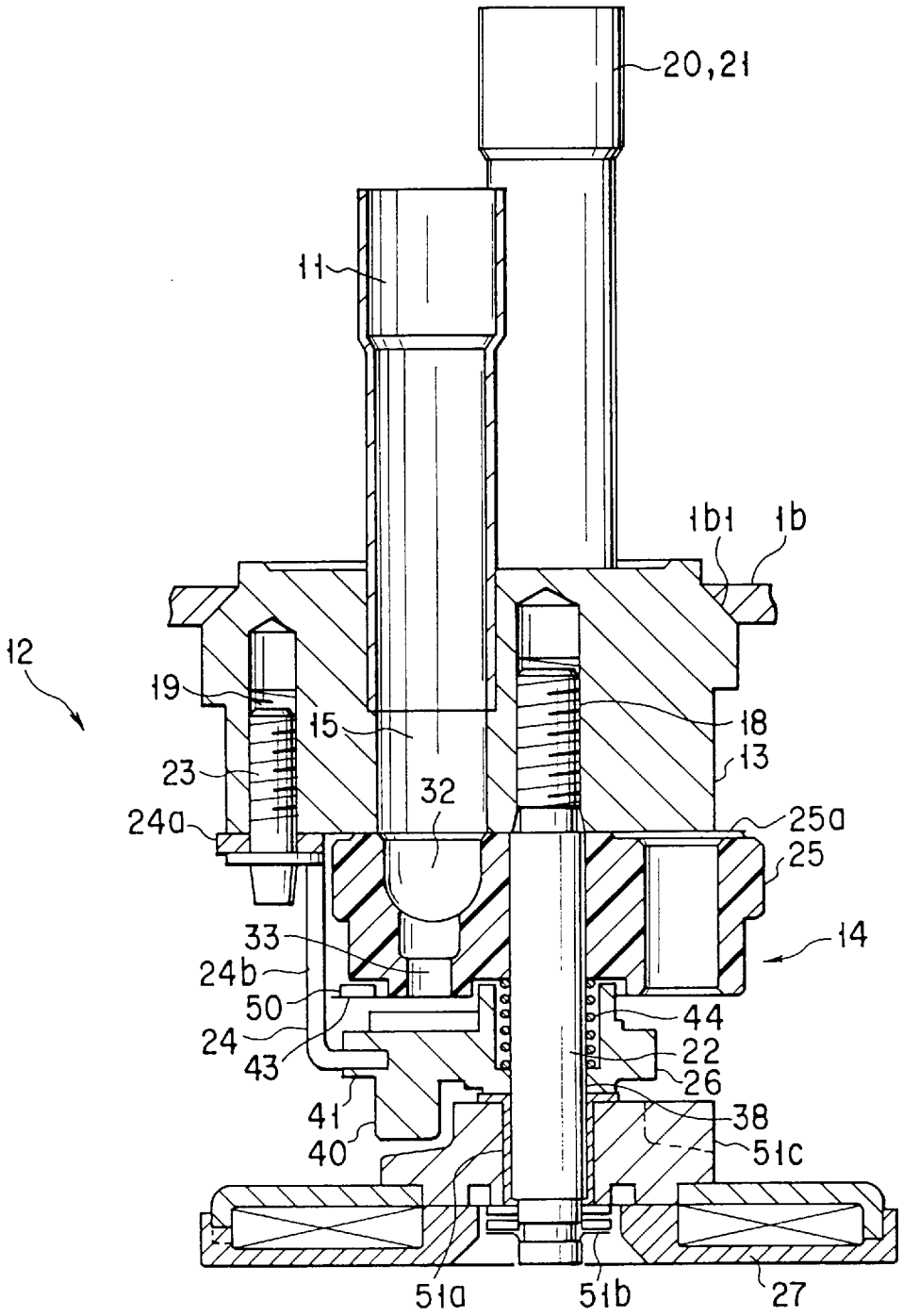
FIG. 2 is a vertical cross-sectional view showing a switching valve according to the first embodiment, with some parts being omitted.

The switching valve 12, as shown in the enlarged view of FIG. 2, is mounted in a mounting hole 1*b*1 formed in the upper casing portion 1*b*. The switching valve 12 comprises a valve body 13 with an upper surface exposed to the outside of the sealed casing 1, and a valve switching assembly 14 provided under the lower surface of the valve body 13 within the sealed casing 1.

Figure 3A:
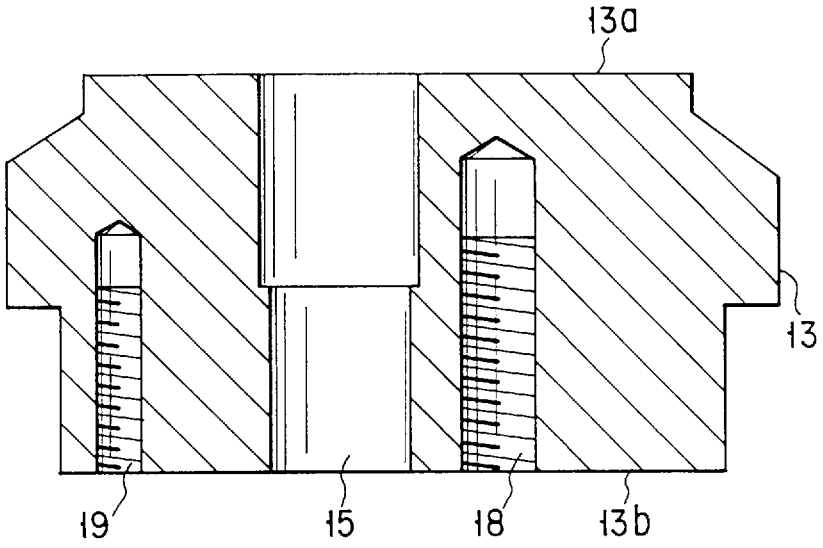
FIG. 3A is a vertical cross-sectional view of a valve body of the switching valve according to the first embodiment.
Figure 3B:
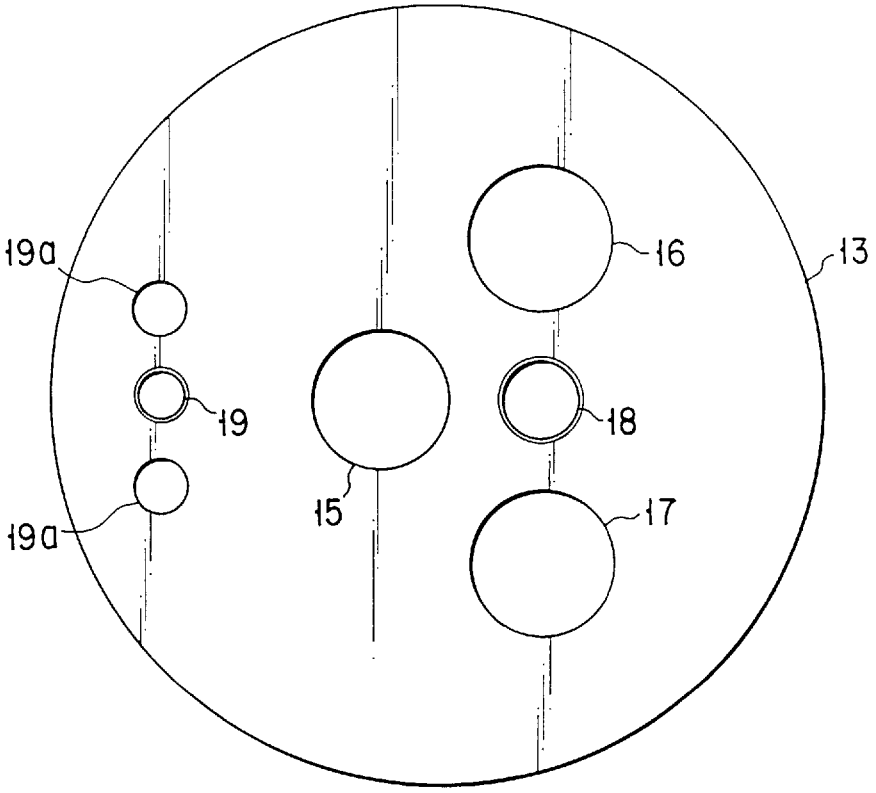
FIG. 3B shows the lower side of the valve body.

FIGS. 3A and 3B are enlarged views showing the valve body 13. An S-hole 15, an E-hole 16 and a C-hole 17 penetrate the valve body 13 from an upper surface portion 13*a* thereof to a lower surface portion thereof 13*b*, with predetermined distances among them.

In addition, two screw holes 18 and 19 are formed in the valve body 13 so as to extend from the lower surface portion 13*b* up to levels below the upper surface portion 13*a*. One of the screw holes, the screw hole 18, is located between the E-hole 16 and C-hole 17. The other screw hole 19 is located on the peripheral side of the S-hole 15.

In particular, the lower surface portion 13*b* is finished to have very high flatness. Holes 19*a* provided on both sides of the screw hole 19 serve to position a stopper 24 (to be described below).

Referring back to FIGS. 1 and 2, the S-hole 15 is connected to the S-pipe 11, and the E-hole 16 and C-hole 17 are connected respectively to an E-pipe 20 and a C-pipe 21 (only one shown).

Figure 8:
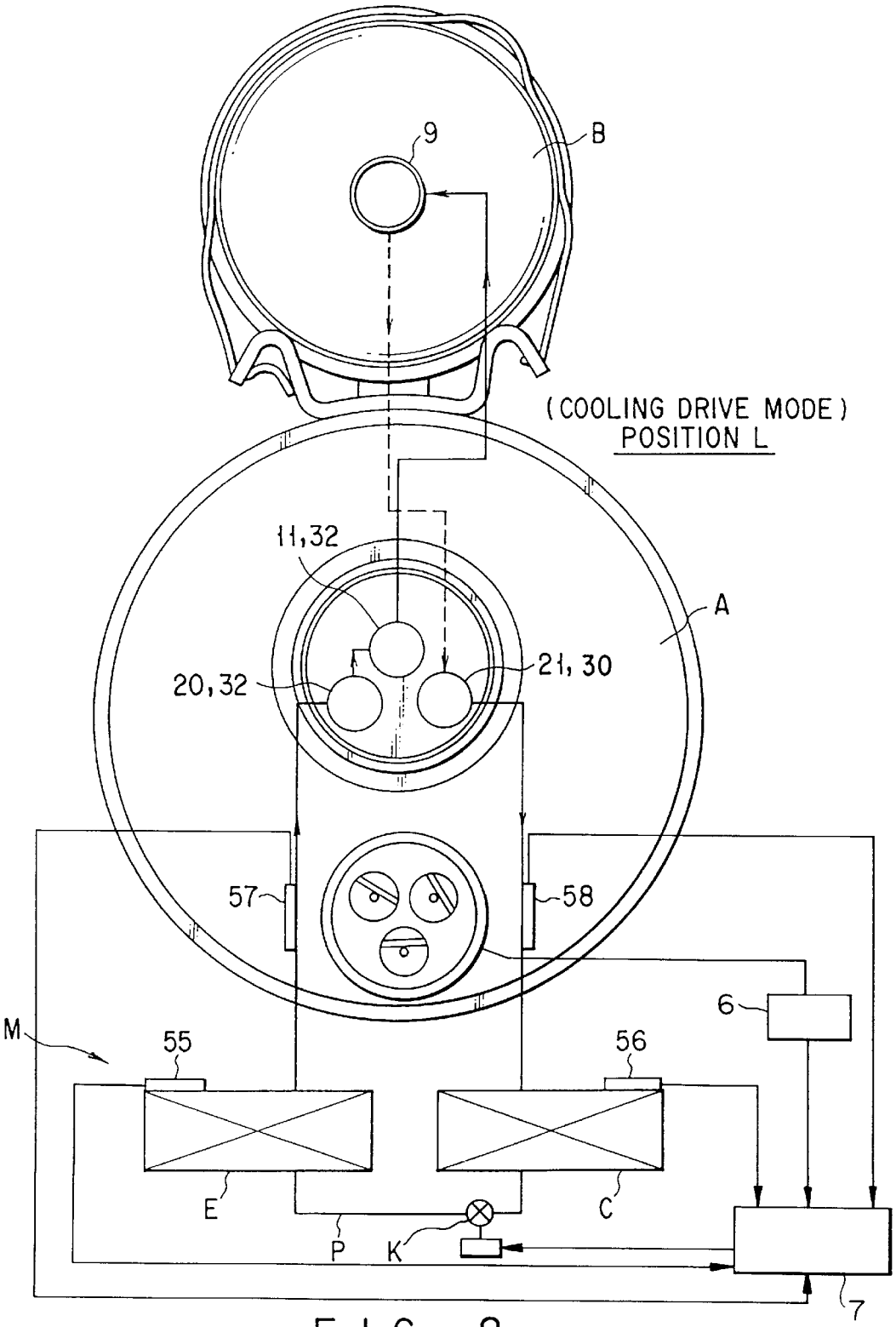
FIG. 8 shows the structure of a refrigeration cycle in a cooling mode according to the first embodiment.
Figure 9:
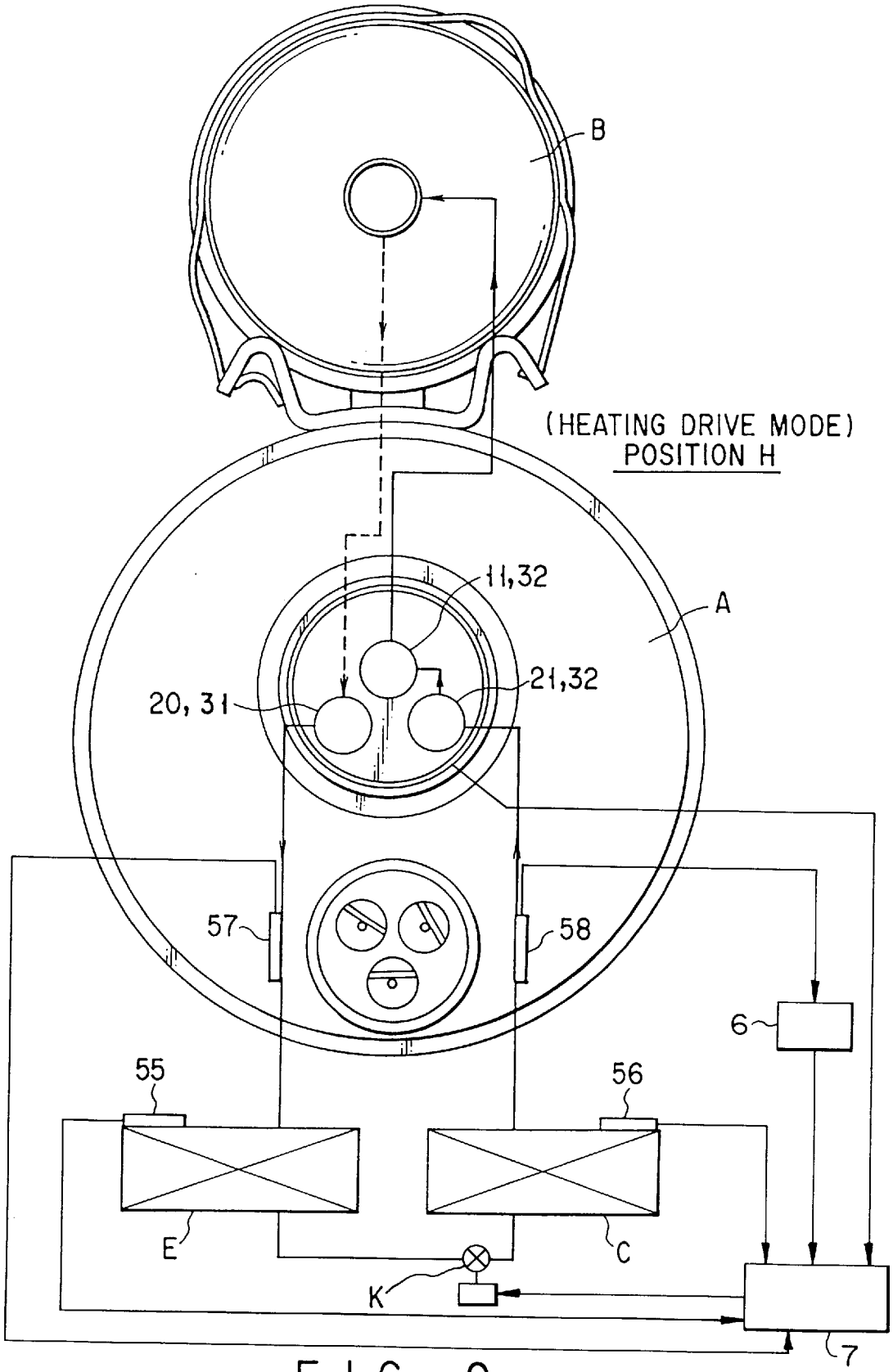
FIG. 9 shows the structure of a refrigeration cycle in a heating mode according to the first embodiment.

As is shown in FIGS. 8 and 9, the S-pipe 11 is connected to the accumulator B juxtaposed with the fluid compressor A via the communication pipe 9. The E-pipe 20 is connected to an indoor heat exchanger E and the C-pipe 21 is to an outdoor heat exchanger C.

A restriction device K is provided midway along a pipe P connecting the indoor heat exchanger E and outdoor heat exchanger C.

Referring back to FIG. 2, a shaft 22 is engaged in the screw hole 18. The shaft 22 is projected below from the lower surface portion 13*b* of valve body 13, and constituent parts of the valve switching assembly 14 are attached to this projected portion.

An attachment screw 23 is engaged in the other screw hole 19. This screw 23 attaches a stopper 24 constituting a part of the valve switching assembly 14 to the valve body 13.

The stopper 24 comprises an attachment seat 24*a* attached to the lower surface portion 13*b* of valve body 13 by means of the attachment screw 23, and a substantially L-shaped stopper portion 24*b* extending straight downward from the attachment seat 24*a* and bending horizontal at its distal end portion.

The valve switching assembly 14 comprises the shaft 22, the stopper 24, a slider 25 engaged with the shaft 22, a sleeve 26 and an upper magnet assembly 27.

The slider 25 is formed, e.g. by means of plastic molding. An upper surface portion 25*a* of slider 25 is in contact with the flat lower surface portion 13*b* of valve body 13. The slider 25 is rotatably supported on the shaft 22. The slider 25 can be rotated while being in contact with valve body 13.

Figure 4A:
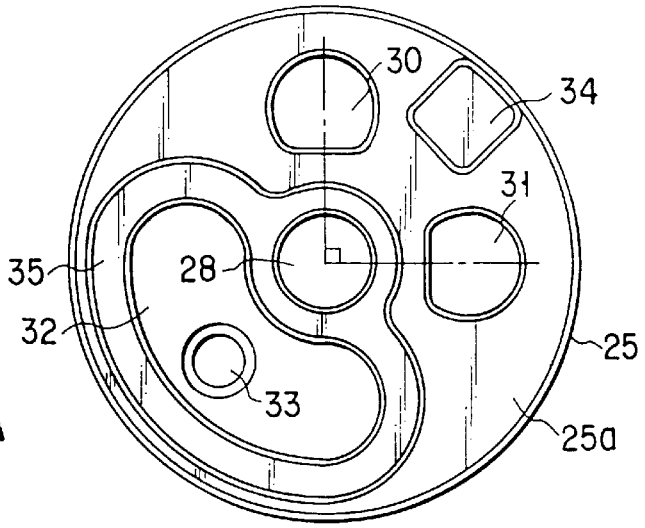
FIG. 4A is a plan view showing the upper surface of a slider of the switching valve according to the first embodiment.
Figure 4B:
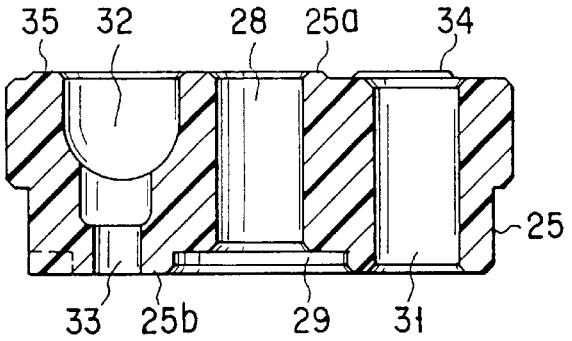
FIG. 4B is a vertical cross-sectional view of the slider.
Figure 4C:
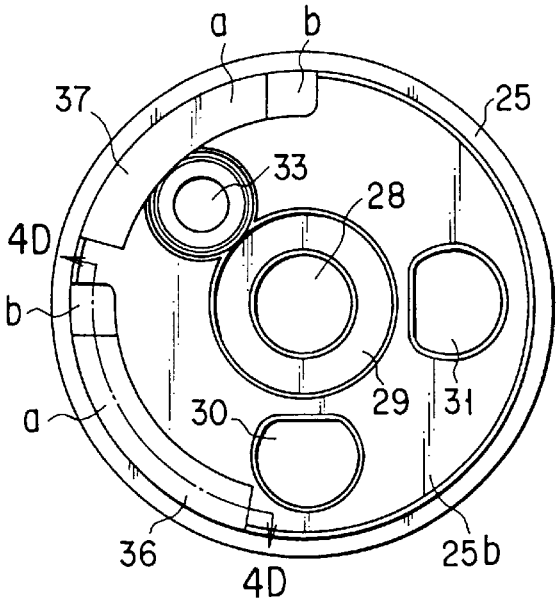
FIG. 4C shows the lower surface of the slider.

As is shown in FIGS. 4A to 4C, an attachment hole 28 is formed along the axis of the slider 25 so as to penetrate from the upper surface portion 25*a* of slider 25 to a lower surface portion 25*b* of slider 25. A recess portion 29 having a diameter greater than the diameter of the attachment hole 28 is defined around a portion of the attachment hole 28, which is located on the lower surface portion (25*b*) side.

A first discharge port 30 and a second discharge port 31 are formed at positions predetermined distances away from the axis of slider 25 and are separated from each other by 90° about the axis of slider 25. The discharge ports 30 and 31 penetrate the slider 25 and open to the upper and lower surface portions 25*a* and 25*b*.

A gas passage 32 with a semicircular cross section is formed with a depth from the upper surface portion 25*a* to a point above the lower surface portion 25*b*. The gas passage 32 has an arcuated plan shape, and a balance port 33 opening to the lower surface portion 25*b* is provided at a substantially middle portion of the gas passage 32.

A shaft 22 is loosely inserted in the attachment hole 28 so as to be rotatable in the circumferential direction of slider 25. In accordance with the position of slider 25, the gas passage 32 is shifted between a position where the gas passage 32 faces the S-hole 15 and E-hole 16 formed in the valve body 13 at the same time, and a position where the gas passage 32 faces the S-hole 15 and C-hole 17 at the same time.

In either position of the gas passage 32, the gas passage 32 faces at least the S-hole 15. Since the S-pipe 11 connected to the S-hole 15 extends from the fluid compressor A and communicates with the accumulator B, the pressure in the gas passage 32 and balance port 33 is constantly set at a low level.

When the gas passage 32 faces both S-hole 15 and E-hole 16, the first discharge port 30 communicates with the C-hole 17. When the gas passage 32 faces both S-hole 15 and C-hole 17, the second discharge port 31 communicates with the E-hole 16.

A rectangular seat surface 34 provided between the first and second discharge ports 30 and 31 on the slider upper surface portion 25*a* and a seat surface 35 surrounding the attachment hole 28 and gas passage 32 serve to reduce the contact area between the slider upper surface portion 25*a* and the valve body lower surface portion 13*b*. In addition, since the seat surfaces 34 and 35 are separated from each other, with the attachment hole 28 interposed, the slider 25 can be prevented from inclining.

A first notch portion 36 and a second notch portion 37 are formed in the slider lower surface portion 25*b*. Specifically, the notch portions 36 and 37 are located along the periphery of slider 25 with a predetermined distance therebetween. The notch portions 36 and 37 have arcuated plan-view shapes.

Figure 4D:
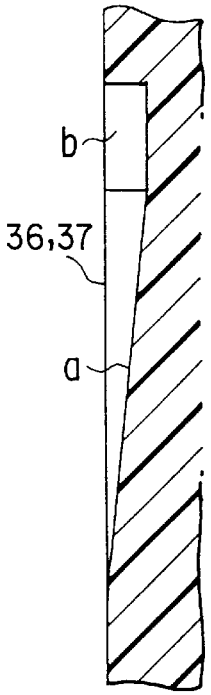
FIG. 4D is a vertical cross-sectional view showing a notch portion in the slider in a developed fashion.

As is shown in FIG. 4D in a developed fashion, each notch 36, 37, as viewed in cross section along its longitudinal axis, comprises an inclined portion a gradually deepened from one end toward the other end, and a flat portion b with a fixed depth formed at the deepest portion of the inclined portion a.

Figure 5A:
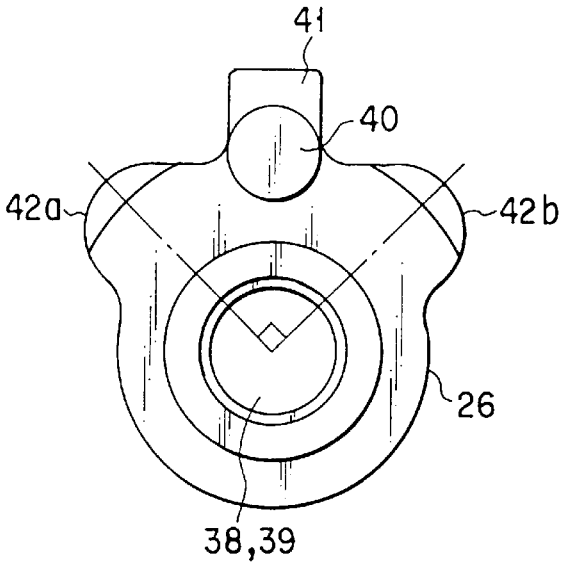
FIG. 5A shows the lower side of a sleeve of the switching valve according to the first embodiment.
Figure 5B:
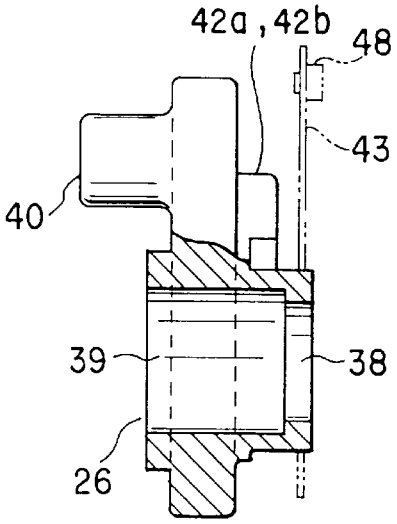
FIG. 5B is a partially cut-out side view of the sleeve.

As is shown in FIGS. 5A and 5B, the sleeve 26 is provided with an attachment hole 38 and a spring support hole 39 having a diameter greater than the diameter of the attachment hole 38. The attachment hole 38 and spring support hole 39 are formed continuous. A downwardly projecting columnar first projection 40 is integrally formed on a peripheral portion of the sleeve 26. A second projection 41 projecting radially outward of the sleeve 26 is formed on a peripheral portion of the first projection 40.

Semicircular projections 42*a* and 42*b* are provided at positions separated from each other by 90° about the axis of the attachment hole 38. The projections 42*a* and 42*b* have shapes corresponding to those of a first projection 46 and a second projection 47 of a pilot valve 43 (to be described later), and overlap the first and second projections 46 and 47.

Referring back to FIG. 2, the shaft 22 is loosely inserted in the attachment hole 38 and the sleeve 26 is rotatably supported. A coil spring 44 serving as elastic member is contained in a space portion defined by the peripheral surface of the shaft 22 and the spring support hole 39.

The coil spring 44 projects from the upper surface portion of sleeve 26 and comes in contact with the recess portion 29 provided in the lower surface portion 25*b* of slider 25. Thus, the coil spring 44 elastically supports the slider 25. The slider 25 is raised and put in slidable contact with the valve body 13 with a predetermined frictional force.

The second projection 41 of sleeve 26 abuts upon the stopper portion 24*b* of stopper 24 attached to the valve body 13, depending on the rotational position of sleeve 26, and further rotation of sleeve 26 in the direction in which the sleeve 26 abuts on the stopper portion 24*b* is prevented.

Figure 6A:
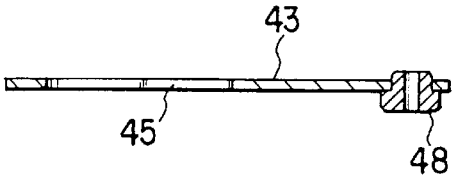
FIG. 6A is a vertical cross-sectional view showing a pilot valve of the switching valve according to the first embodiment.
Figure 6B:
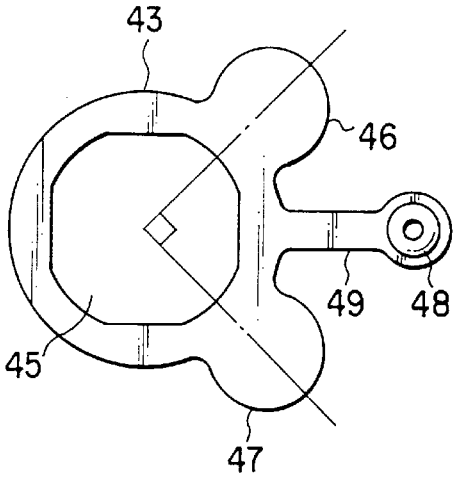
FIG. 6B shows the lower side of the pilot valve.

As is shown in FIGS. 6A and 6B, the pilot valve 43 is formed mainly of a very thin plate (about 0.3 mm thick) which is resilient in the thickness direction thereof. The pilot valve 43 is provided with an attachment hole portion 45 with four flat surfaces.

The pilot valve 43 is provided with the first projection 46 and second projection 47 substantially circular in shape (with a degree of circularity greater than that of a semicircle) at positions separated from each other by 90° about the axis of the attachment hole portion 45. A driver 49 having a hollow boss portion 48 at its distal end portion is projected integrally from a portion of pilot valve 43 between the first and second projections 46 and 47.

Referring back to FIG. 2, the attachment hole portion 45 in the pilot valve 43 is engaged with one end portion of sleeve 26. The pilot valve 43 is aligned with the sleeve 26 by the engagement between the attachment hole portion 45 and sleeve 26. As has been described above, the projections 42*a* and 42*b* of sleeve 26 are positioned to exactly face the first and second projections 46 and 47 of pilot valve 43.

The pilot valve 43 in the assembled state is put in close contact with the lower surface portion 25*b* of slider 25. Accordingly, depending on the position of the pilot valve 43, one of the first and second projections 46 and 47 opens/closes the balance port 33 opening to the slider lower surface portion 25*b*.

When the first projection 46 closes balance port 33, the boss portion 48 of driver 49 is located on the flat portion b of first notch 36. When the second projection 47 closes the balance port 33, the boss portion 48 is located on the flat portion b of second notch 37.

For example, when the pilot valve 43 rotates in a direction away from the inclined portion a (clockwise in FIG. 4C) from the state in which the boss portion 48 faces the flat portion b of the notch 36 (37), the slider 25 rotates in the same direction by virtue of the shape of each notch.

Specifically, the first and second notches 36 and 37 of slider 25 and the driver 49 of pilot valve 43 constitute a moving mechanism 50 for rotating the slider 25.

The upper magnet assembly 27 is rotatably engaged with a lowest portion of the shaft 22, with a collar 51*a* of a material being smooth in characteristic interposed. The upper magnet assembly 27 is prevented from being removed from the shaft 22 by means of a stop ring 51*b* attached to the lower end portion of shaft 22.

An upper end portion of the upper magnet assembly 27 is integrally provided with a projecting portion 51*c*. The projecting portion 51*c* abuts on the first projection 40 of sleeve 26, depending on the rotational position of the upper magnet assembly 27.

On the other hand, as shown in FIG. 1, a lower magnet assembly 52 is attached to an upper end portion of the rotary shaft 2 projecting from the motor unit 3. Specifically, the lower magnet assembly 52 is fixed to an upper part of the rotor 4 of motor unit 3 by means of a magnet holder 53 in such a manner that a central portion of the magnet holder 53 is engaged with a stopper projection formed on the rotary shaft 2 of rotor 4.

A gap is provided between the lower magnet assembly 52 and upper magnet assembly 27, and these magnet assemblies 52 and 27 magnetically influence each other. Specifically, if the lower magnet assembly 52 rotates in accordance with rotation of the motor unit 3, the upper magnet assembly 27 rotates in the same direction.

Thus, a magnet coupling 54 or magnetic coupling means is constituted by the upper magnet assembly 27 as second magnet and the lower magnet assembly 52 as first magnet.

The outside diameter of the magnet coupling 54 is less than the inside diameter of a coil end 5*a* of the stator 5 of motor unit 3 and is disposed inside the coil end 5*a*.

A description will now be given of the operation of the fluid compressor A, the operation of the switching 12 contained in the compressor A, and the heat pump type refrigeration cycle.

The motor unit 3 of fluid compressor A is actuated to enable the compressor mechanisms Fa and Fb to compress the refrigerant gas. For example, when the rotary shaft 2 rotates forwardly (i.e. clockwise, as viewed from the bottom side), a torque is transmitted from the lower magnet assembly 52 to the upper magnet assembly 27 in a non-contact manner by virtue of the construction of the magnet coupling 54. Thus, the upper magnet assembly 27 is rotated in synchronism with the rotation of the rotary shaft 2 and lower magnet assembly 52.

When the upper magnet assembly 27 has rotated forwardly and the projection portion 51*c* has come in contact with the peripheral surface of the first projection 40 of sleeve 26, the sleeve 26 begins to turn synchronously. Then, when the sleeve 26 has made a single turn, the side face of the second projection 41 abuts upon the stopper portion 24*b* of stopper 24 and the rotation of the sleeve 26 is stopped.

Figure 7A:
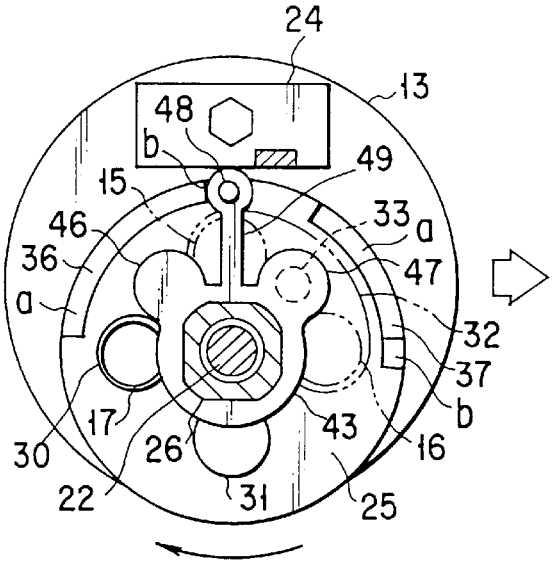
FIGS. 7A to 7D illustrate in succession the states of the switching operations according to the first embodiment.

As is shown in FIG. 7A, the boss portion 48 provided at the distal end portion of driver 49 of pilot valve 43, which has rotated along with the sleeve 26, engages the flat portion b of first notch 36 formed in the slider 25.

As will be described later, in this position, the second projection 47 of pilot valve 43 closes the balance port 33 formed in the lower surface portion 25*b* of slider 25. This position of slider 25 is referred to as "position L" hereinafter.

On the other hand, in the position L, the gas passage 32 formed in the upper surface portion 25*a* of slider 25 communicates with both the S-hole 15 and E-hole 16 provided in the valve body 13. The C-hole 17 communicates with the first discharge port 30 of slider 25.

While the slider 25 remains in the position L, the upper magnet assembly 27 is not rotated since the second projection 41 of sleeve 26 abuts upon the stopper portion 24*b*. The lower magnet assembly 52, however, is freely rotatable.

Accordingly, the compressor mechanism units Fa and Fb suck and compress a low-pressure refrigerant gas fed from the accumulator B, and discharge a high-pressure refrigerant gas to the inside of the sealed casing 1.

The high-pressure gas filled in the sealed casing 1 is discharged from the first discharge port 30 of slider 25 and the C-hole 17 of valve body 13 to the outdoor heat exchanger C via the C-pipe 21, as shown in FIG. 8.

The high-pressure refrigerant gas is condensed and liquefied in the outdoor heat exchanger C and then fed to the restriction device K. The refrigerant gas is expanded under negative pressure and supplied to the indoor heat exchanger E. In the indoor heat exchanger E, heat is exchanged between the refrigerant gas and air supplied to be conditioned. Thus, the refrigerant gas evaporates. The heat-exchanged air, which has been deprived of evaporation latent heat and cooled and dried, is blown to the room to be conditioned. Accordingly, in the position L the cooling operation for the room is carried out.

The refrigerant gas evaporated in the indoor heat exchanger E is guided into the fluid compressor A via the E-pipe 20. Since the E-hole 16 connected to the E-pipe 20 is made to communicate with the S-hole 15 by means of the gas passage 32 of slider 25, the evaporated refrigerant gas flows from the E-pipe 20 to the S-hole 15 and S-pipe 11 via the gas passage 32.

Specifically, the low-pressure evaporated refrigerant is temporarily guided into the fluid compressor A and then the refrigerant is guided from the fluid compressor A into the accumulator B. In the accumulator B, the refrigerant is separated into gas and liquid and then the gas is guided once again to the compressor mechanisms Fa and Fb in fluid compressor A.

In FIG. 8, reference numeral 55 denotes a temperature sensor for the indoor heat exchanger E, 56 a temperature sensor for the outdoor heat exchanger C, 57 a first pressure sensor, and 58 a second pressure sensor. These sensors 55 to 58 are electrically connected to the controller 7 (FIG. 1) and constitute monitor means M for producing sense signals.

Figure 7B:
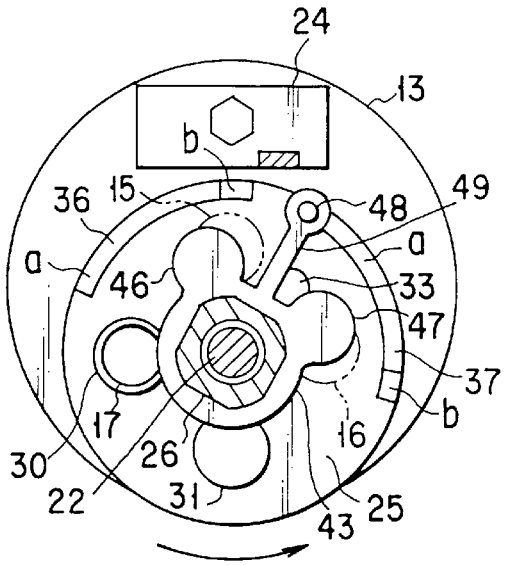
Figure 7D:
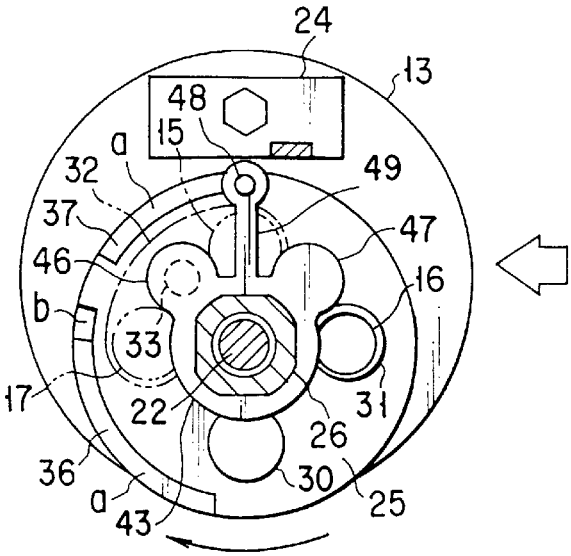

When the cooling mode is switched to the heating mode, the slider 25 is finally set in a position H, as shown in FIG. 7D, as will now be described below.

When the controller 7 has received a mode switch command signal from an operation unit such as a remote controller, the controller 7 temporarily stops the operation of the motor unit 3 of fluid compressor A in a first step.

In a second step, the controller 7 drives the motor unit 3 in a reverse direction.

Since the lower magnet assembly 52 provided on the motor unit 3 is rotated reversely, the upper magnet assembly 27 magnetically coupled to the lower magnet assembly 52 is also rotated in the same direction (i.e. counterclockwise).

When the upper magnet assembly 27 has made a single turn in the counterclockwise direction, the projection portion 51*c* of upper magnet assembly 27 comes in contact with the opposite side face of the first projection 40 of sleeve 26 and rotates the sleeve 26 in the same direction.

If the sleeve 26 and pilot valve 43 rotate as one body in the direction, the boss portion 48 of driver 49 moves from the flat portion b to the inclined portion a of the first notch 36 and exits from the inclined portion a. Accordingly, the position of slider 25 remains unchanged during this time.

As the pilot valve 43 moves, the second projection 47 moves away from the balance port 33 of slider 25. Thus, the balance port 33 is opened. Part of the high-pressure gas filled in the sealed casing 1 is guided to the opened balance port 33 and then to the gas passage 32 communicating with the balance port 33.

As a result, a pressure difference acting on the slider 25 is eliminated and a force pressing the slider 25 upon the valve body 13 is lost. Specifically, a frictional force acting between the upper surface portion 25*a* of slider 25 and the lower surface portion 13*b* of valve body 13 is eliminated and the slider 25 can rotate with a very small torque.

The pilot valve 43 continues to rotate along with the sleeve 26, and the boss portion 48 of driver 49 departs from the first notch 36. After a predetermined time period, the boss portion 48 is led to the second notch 37. Specifically, the boss portion 48 once falls in the flat portion b of second notch 37, moves along the inclined portion a and stops at the edge of the inclined portion a, as is shown in FIG. 7B.

When the sleeve 26 has made a single turn, the opposite side face of the second projection 41 abuts upon the stopper 24 and the rotation of the sleeve 26 is stopped.

The above-described gas balance step may be carried out in the state in which power is being supplied to the motor unit 3 to produce a torque. Even if the supply of power is stopped, no problem arises in function.

In a third step, the controller 7 drives the motor unit 3 forwardly.

Accordingly, the projection portion 51*c* of upper magnet assembly 27 separates from the first projection 40 of sleeve 26, makes a single turn and comes into contact with the opposite side face of the first projection one again, thus rotating the sleeve 26 in the same direction.

Figure 7C:
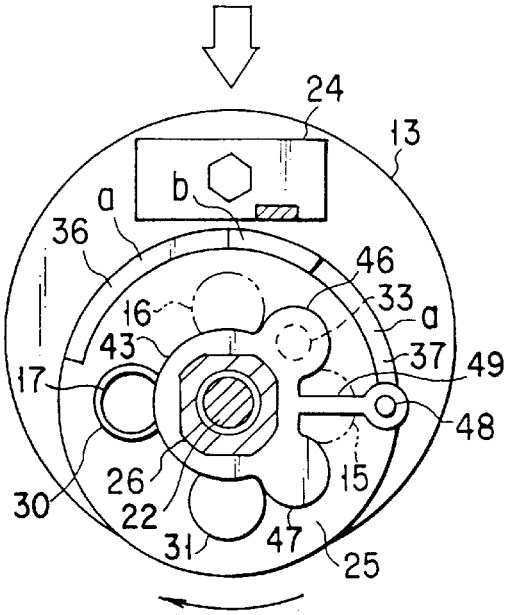

The sleeve 26 and pilot valve 43 rotate as one body in the same direction. The boss portion 48 of driver 49 moves from the inclined portion a to the flat portion b of second notch 37 and abuts upon the end wall of the flat portion b, as is shown in FIG. 7C.

The slider 25 rotates in the same direction in accordance with the movement of pilot valve 43 by virtue of the shape of the second notch 37. In other words, the driver mechanism 50 operates. In this state, the first projection 46 closes the balance port 33, and the flow of high-pressure gas to the gas passage 32 is blocked.

The sleeve 26, pilot valve 43 and slider 25 rotate in the same direction at a time along with the upper magnet assembly 27. When these parts have made a single turn, the second projection 41 of sleeve 26 abuts upon the stopper 24.

When the rotation of the sleeve 26 is stopped, the pilot valve 43 stops at the same position. Needless to say, the upper magnet assembly 27 and slider 25 stop, too. The position of these elements, as is shown in FIG. 7D, is referred to as "position H."

In the position H, the gas passage 32 formed in the upper surface portion 25*a* of slider 25 communicates with both S-hole 15 and C-hole 17 formed in the valve body 13, and the E-hole 16 communicates with the second discharge port 31 in the slider 25.

The balance port 33 remains closed by the first projection 46, and gas balance is not effected.

While the slider 25, sleeve 26 and upper magnet assembly 27 are being situated in the position H, the upper magnet assembly 27 does not rotate but the lower magnet assembly 52 rotates freely.

As is shown in FIG. 9, the compressor mechanism units Fa and Fb in the fluid compressor A suck and compress the low-pressure refrigerant gas from the accumulator B and discharge the compressed high-pressure gas to the inside of the sealed casing 1.

The high-pressure gas filled in the sealed casing 1 is introduced into the second discharge port 31 of slider 25 and the E-hole 16 of valve body 13 and guided to the indoor heat exchanger E.

The refrigerant gas is condensed in the indoor heat exchanger E and releases heat of condensation to heat exchange air. The heat exchange air is heated and blown to the room to be conditioned. Specifically, in the position H, the heating operation for the room is carried out.

The refrigerant liquefied in the indoor heat exchanger E is led to the restriction device K and expanded there under negative pressure. The refrigerant is then led to the outdoor heat exchanger C and evaporated there. The evaporated gas is guided to the compressor A via the C-pipe 21.

The C-hole 17 connected to the C-pipe 21 communicates with the S-hole 15 via the gas passage 32 of slider 25. The evaporated refrigerant is led from the C-pipe 21 to the S-hole 15 and S-pipe 11 via the gas passage 32.

Accordingly, the evaporated refrigerant is temporarily led to the fluid compressor A and then guided to the accumulator B from the fluid compressor A. In the accumulator B, the refrigerant is separated into liquid and gas and supplied once again to the compressor mechanism units Fa and Fb of fluid compressor A, as described above.

When the heating mode is switched to the cooling mode, the above-described procedure is repeated from the state shown in FIG. 7D. Specifically, the motor unit 3 is driven in the reverse direction, and the balance port 33 is temporarily opened. Then, the motor unit 3 is driven in the forward direction and the slider 25 is rotated. Thus, the slider 25 is restored to the position L from the position H.

In this manner, the first and second notches 36 and 37 of slider 25, as well as the first and second projections 46 and 47 of pilot valve 43 for opening/closing the balance port 33 formed in slider 25, are switched.

In fact, the heating mode is often switched to the cooling mode when the outdoor heat exchanger C needs to be defrosted in winter. The switching valve 12 of the present invention can be operated exactly and quickly with a weak switching torque and without leak of refrigerant.

In the case of a rotary type compressor in which the pressure in sealed casing 1 of fluid compressor A will rise, the pressure in the sealed casing 1 is maintained at high level during operation and, after the compressor is stopped, a residual pressure is present for a certain time period.

During operation, a maximum pressure of several-ten $Kg/cm^2$ acts upon the slider 25 of switching valve 12, and the upper surface portion 25*a* of slider 25 is urged on lower surface portion 13*b* of valve body 13. By virtue of the urging force, the upper surface portion 25*a* of slider 25 and the lower surface portion 13*b* of valve body 13 are sealed no substantial gas leak occurs from the sealing surface of slider 25 during operation and the position of slider 25 is maintained.

However, immediately after the stop of operation of the compressor, the residual pressure is still high and the slider 25 cannot be rotated with a torque of the motor unit 3. In particular, with the above-described structure of the magnet coupling 54, the upper and lower magnet assemblies 27 and 52 slip on each other.

To obviate this drawback, the switching valve of the present invention is provided with the pilot valve 43, which constitutes the driver mechanism 50, and the notches 36 and 37. Before carrying out the switching operation of the slider 25, the balance port 33 formed in the slider 25 is opened and the gas balance is forcibly effected. Thereby, the switching, for example, from the heating mode to the defrosting mode, can be performed quickly and exactly.

The gas balance can be quickly effected by using an electronic automatic expansion valve as restriction device K and fully opening the valve at the time of mode switching. Alternatively, the electronic expansion valve may be used in combination with the moving mechanism 50.

Since the pilot valve 43 has resiliency in its thickness direction, it has high sealing properties to the balance port 33. In addition, since the pilot valve 43 is formed of a material being smooth in characteristic, it smoothly slides on the slider 25. Thus, the pilot valve 43 can exactly engage the first and second notches 36 and 37 and drive the slider 25 only in one direction.

The coil spring 44 supported in the sleeve 26 provides a predetermined frictional force (pre-load) acting between the upper surface portion 25*a* of slider 25 and the lower surface portion 13*b* of valve body 13. Thus, the position of slider 25 is kept even if a friction occurs between the pilot valve 43 and the lower surface portion 25*b* of slider 25.

When the upper magnet assembly 27 rotates, the projection portion 51*c* thereof abuts upon the first projection 40 of sleeve 26 and rotates the sleeve 26 in the same direction. When the sleeve 26 has made a single turn, the second projection 41 of sleeve 26 abuts on the stopper 24 extending from the valve body 13 and the rotation of sleeve 26 is stopped.

Accordingly, the upper magnet assembly 27 and sleeve 26 make two turns at maximum in the forward or reverse direction, and each have an idling function with single-turn idling.

Specifically, the pistons of the compressor mechanism units Fa and Fb may move due to residual pressure after the driving thereof is stopped and the rotor 4 integral with the rotary shaft 2 may rotate once at maximum. In this case, however, the switching valve 12 has a single-turn idling function. Even if the rotor 4 rotates once at maximum despite a valve switching command being absent, malfunction does not occur.

The slider 25 is switched by the torque produced by the magnet coupling 54 after the motor unit 3 is reversely rotated and the gas balance is effected. The time needed for switching the slider 25 is determined by both the speed of effecting gas balance and the torque produced by the magnet coupling 54.

The speed of effecting the gas balance is proportional to the cross-sectional area of the balance port 33 formed in the slider 25. If the diameter of the balance port 33 is increased, the time needed for switching the slider 25 is shortened.

If the diameter of balance port 33 is increased more than needed, the torque needed for rotating the pressurized pilot valve 43 increases. Consequently, the force of the magnet coupling 54 needs to be increased, which is disadvantageous from the standpoint of the space for installation and the running cost.

According to experimental data, in the case of an air conditioner of 1 HP in which the amount of gas imbalance is 0.5 $Kg/cm^2$, the optimal diameter of the balance port 33 is 1 mm to 4 mm. In this case, the time needed for switching the slider 25 is about 5 to 10 seconds and is very short.

Needless to say, the switching time varies depending on the driving mode and condition. The switching time from the reverse rotation to forward rotation is thus determined in advance in accordance with the driving mode.

Alternatively, the switching time may be determined surely and relatively easily by using the monitor means M comprising the temperature sensors 55 and 56 of the indoor and outdoor heat exchangers and first and second pressure sensors 57 and 58 in the refrigeration cycle.

For example, the switching time is estimated from the high-pressure side pressure (Pd) and low-pressure side pressure (Pc) which are calculated in advance on the basis of the temperature sense signals from the temperature sensor 55 for sensing the temperature of the indoor heat exchanger E and the temperature sensor 56 for sensing the temperature of the outdoor heat exchanger C.

Alternatively, it is determined that the degree of gas has fallen in a predetermined range, if a difference between the temperature sensed by the indoor heat exchanger temperature sensor 55 and the temperature sensed by the outdoor heat exchanger temperature sensor 56 has fallen in a predetermined range after the compressor A is halted or reversely rotated.

Alternatively, the switching time can be estimated more easily by directly calculating the pressure difference between the high-pressure side and the low-pressure side on the basis of the sense signals of the first and second pressure sensors 57 and 58.

The next driving mode cannot be determined unless the system recognizes the position of the slider 25 in advance. No problem arises, however, if the storage circuit in the controller 7 stores the data on the previous driving mode.

There is a concern that the switching is not actually effected due to malfunction, even if the operation for switching the slider 25 is carried out. This occurs, for example, when the gas balance is not sufficiently effected or when the slider 25 is not completely switched due to accidental non-smooth rotation despite the motor unit 3 being driven.

In order to easily find such malfunction, the monitor means M comprising the temperature and pressure sensors 55 to 58 is provided to monitor the driving state.

For example, in the cooling driving mode, the temperature of the outdoor heat exchanger (condenser) C must be higher than that of the indoor heat exchanger (evaporator) E. However, the actual driving mode may be the heating driving mode.

Such a malfunction of the valve switching can be monitored by the temperature sensors 55 and 56. In this case, an additional time is consumed to sufficiently effect the gas balance, and thereafter the switching operation of slider 25 is carried out once again. Thus, the valve is completely switched to the normal driving mode.

It has been confirmed that sufficient gas balance is normally effected three minutes after the stop of the driving of the system. It is considered, therefore, that the valve switching is effected without fail if the valve switching operation is carried out during a relatively long halt time of the system driving (more than five minutes).

Accordingly, the valve switching can be effected even if the reverse rotation of the motor unit 3 is changed to the forward rotation after a temporary stop.

If there is a concern that the position of the slider 25 may be slightly displaced from the normal position, the valve switching is effected by turning on power while the system is being halted and the position of the slider is initialized.

Specifically, the valve switching operation is carried out twice, and the valve is switched from the position L to position H and again to position L. Thus, the position of slider 25 is initialized.

If the speed of rotating the rotor 4 is too high, the shock on the sleeve 26 hitting the stopper 24 is very great, resulting in abnormal noise or fault of the valve assembly. It is advantageous, therefore, to decrease the rotational speed of rotor 4 at the time of valve switching.

In the present invention, the performance of the motor unit 3 of fluid compressor A can advantageously be varied by the inverter 6.

The magnet coupling 54 is situated above the motor unit 3 and radially inside the stator 5. Thus, the same operational advantage as a so-called oil separator can be obtained.

If the motor unit 3 is not used for a long time, a lubricant runs short in the switching valve 12 and a great torque is required in actually switching the valve. In such a case, the compressor mechanism units are driven prior to the valve switching to supply the switching valve 12 with lubricant.

Since the first and second notches 36 and 37 functioning as cams in switching the switching valve 12 and the balance port 33 are integrally formed in the slider 25, the number of parts is reduced and the slider 25 can be molded as one body.

If the switching of the valve 12 is interlocked with the switching between the cooling mode and heating mode, which is instructed by a remote controller of the air conditioner, the driving mode can be exactly switched as the user desires.

The above-described fluid compressor can be used not only in the refrigeration cycle of the air conditioner, as mentioned above, but also in a refrigerator. In the latter case, the defrosting of the evaporator can advantageously be performed in a short time.

In the above-described first embodiment, the slider 25 is provided with the balance port 33 for forcibly balancing the high-pressure side and the low-pressure side in the refrigeration cycle at the time of switching the driving mode. However, the structure for gas balance is not limited to this.

For example, the valve body 13 may be provided with a balance circuit and the shaft 22 may be provided with a notch. The shaft is rotated to make the balance circuit communicate with the notch, thereby effecting gas balance.

When the position of slider 25 is switched, the rotor 4 of the motor unit is reversely rotated to open the balance port 33, and then the rotor 4 is forwardly rotated. However, the slider 25 may be switched in another way. It is possible to reversely rotate the rotor 4 to drive the pilot valve 43 alone, following which the slider 25 is moved to a predetermined position.

In the first embodiment, the pressure within the sealed casing 1 of fluid compressor A is set at high level. However, the pressure within the sealed casing 1 may be set at low level.

Figure 10:
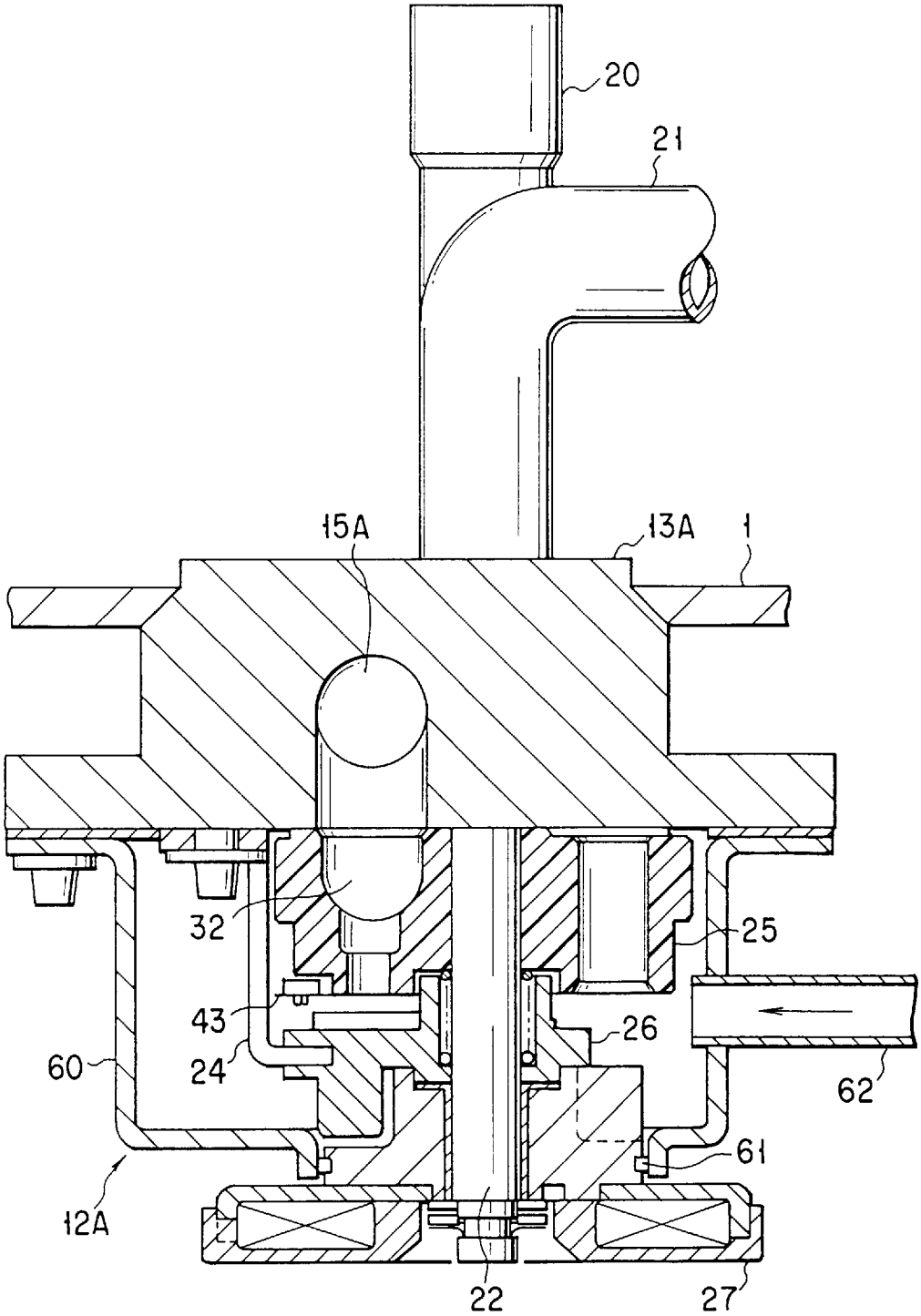
FIG. 10 is a vertical cross-sectional view of a switching mode according to a second embodiment of the invention.

FIG. 10 shows a switching valve 12A according to a second embodiment of the invention, wherein the pressure in the sealed casing 1 is set at low level.

The structure of the second embodiment is the same as that of the first embodiment except for a valve body 13A attached directly to the sealed casing 1. The slider 25 provided under the valve body 13A, the sleeve 26 having the pilot valve 43 integrally, and the upper magnet assembly 27 are the same.

The E-hole and C-hole (not shown) are formed in the valve body 13A at the same positions as in the first embodiment. The E-pipe 20 and C-pipe 21 are connected to the E-hole and C-hole. As is shown in FIG. 10, an S-hole 15A is opened directly to the inside of the sealed casing 1 from the side face of the valve body 13A.

Only the E-pipe 20 and C-pipe 21 are connected to the sealed casing 1, and the external appearance of the switching valve 12A is made simpler than that of the valve 12 shown in FIG. 1.

A chamber 60 is attached to a peripheral end portion of the lower surface portion of the valve body 13A. The chamber 60 surrounds the slider 25, sleeve 26, pilot valve 43, and the peripheral surface of the upper magnet assembly 27 having a projection portion 52. In particular, a seal member 61 is provided between the upper magnet assembly 27 and chamber 60, thus sealing the inside of the chamber 60.

A high-pressure gas introducing pipe 62 communicating with the discharge portion of the compressor mechanism unit (not shown) is connected to the peripheral surface of the chamber 60. The suction portion of the compressor mechanism unit is opened to the inside of the sealed casing. With this structure, the accumulator is not needed.

In the fluid compressor having the above switching valve 12A, a low-pressure gas is filled in the sealed casing 1. Thus, the pressure in the sealed casing 1 is set at low level.

The high-pressure gas compressed in the compressor mechanism unit is introduced into the high-pressure gas introducing pipe 62 and filled in the chamber 60. The high-pressure gas is guided into the C-pipe 21 or E-pipe 20 in accordance with the above-described switching operation.

In the first and second embodiments, the motor unit 3 is situated in the upper part of the fluid compressor, and the switching valve 12 (12A) is disposed in the space above the motor unit. The arrangement of these parts is not limited to this. The compressor mechanism unit may be disposed in the upper part of the fluid compressor, and the motor unit may be disposed in the lower part of the fluid compressor.

In this case, the switching valve 12 is situated in the lower part of the sealed casing 1. Although the switching valve 12 is immersed in the lubricant reservoir formed in the bottom part of the sealed casing 1, no problem will arise in the switching operation. Rather, the gas seal properties of the slider 25 are enhanced because of the presence of the lubricant, and the switching operation is performed more smoothly.

However, the lower magnet assembly 52 attached to the rotary shaft 2 is rotated at all times. In order to reduce rotational resistance, it is desirable that the lower magnet assembly 52 be not immersed in the lubricant.

In the above embodiments, the magnet coupling 54 is attached to the rotor 4 of the motor unit 3. However, the magnet coupling 54 may not be attached to the rotor 4, if the magnet coupling 54 is rotated in synchronism with the rotor 4.

Figure 11:
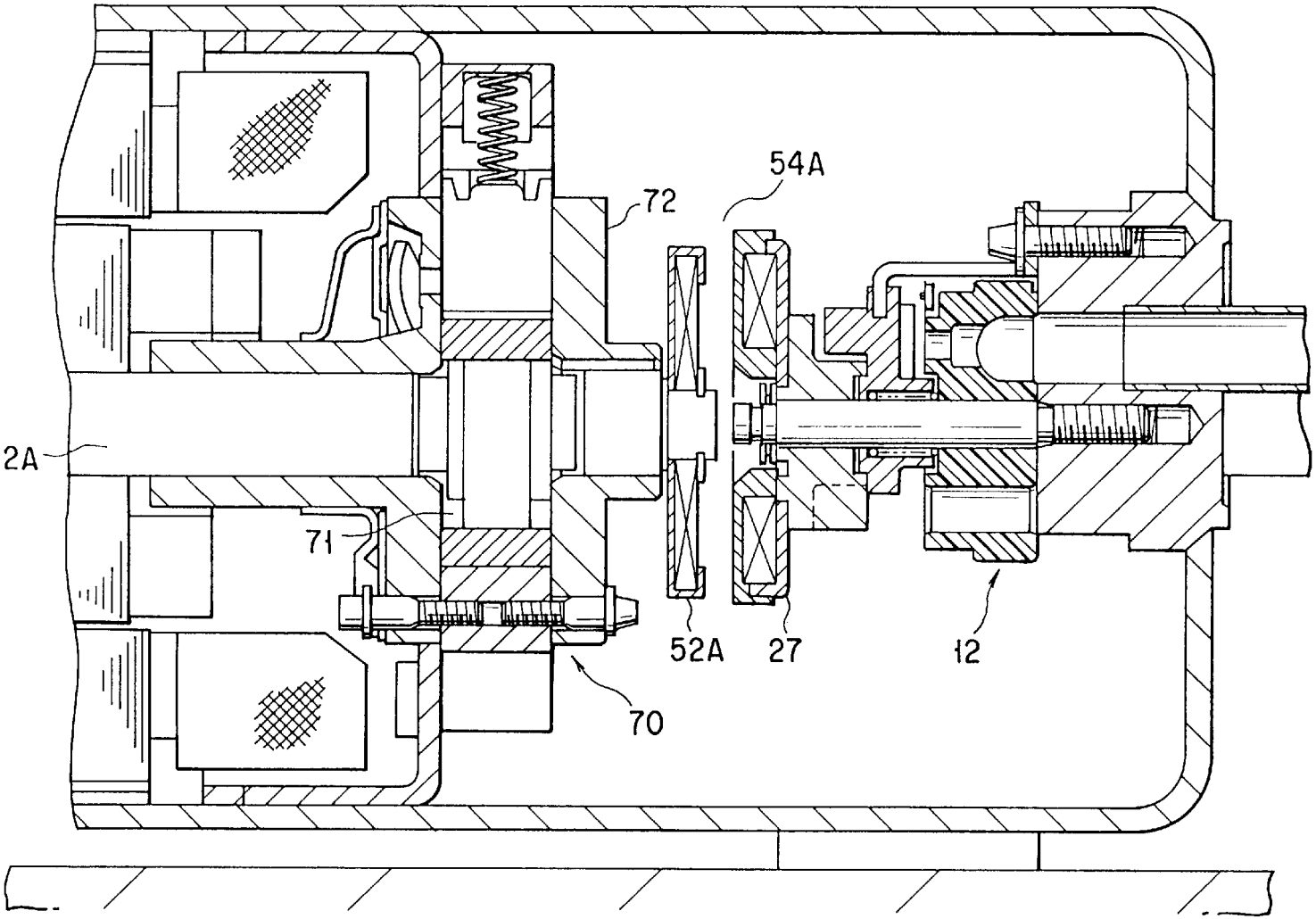
FIG. 11 is a vertical cross-sectional view showing a fluid compressor according to a third embodiment of the invention, with some parts being omitted.

For example, in the case of a so-called horizontal type compressor according to a third embodiment of the invention wherein a rotary shaft 2A is situated horizontal, as shown in FIG. 11, a magnet coupling 54A may be attached to an end portion of a rotary type compressor mechanism unit 70.

More specifically, a sub-bearing 72 defining a cylinder chamber 71 rotatably supports an end portion of the rotary shaft 2A. The end portion of the rotary shaft 2A is projected from the sub-bearing 72, and a first magnet or a driving magnet assembly 52A is provided on the projected end portion of shaft 2A.

A second magnet or a driven magnet assembly 27 and the other parts of the switching valve 12 may have the same structures and functions as those of the preceding embodiments.

In the third embodiment, two magnets 52A and 27 of magnetic coupling means 54A are opposed to each other. However, only one of the magnets 52A and 27 needs to be formed as magnet, and the other may be a non-magnetized magnetic material.

Alternatively, the magnetic coupling means 54 may comprise a first magnetic material formed on the rotor 4 of motor unit 3 and a second magnetic material formed on the switching valve 12, and at least one of the magnetic materials may be a magnet. In this case, too, the first and second magnetic materials are situated in a non-contact state and a torque can be transmitted between them.

If both the first and second magnetic materials are magnets, the following problem arises. When one of the magnets is stopped and the other is rotated after the switching valve has been switched, the magnetic fields of both magnets become in phase periodically, and attraction and repulsion are repeated alternately. Thus, a disturbance and, as a result, abnormal vibration may occur.

In the third embodiment, the non-magnetized magnetic material is influenced by the magnetic field of the magnet and a torque is transmitted by a sucking action while the non-magnetized magnetic material is magnetized with a predetermined phase difference therebetween. Even if one of the magnetic material is stopped, their magnetic fields do not become in phase. Thus, no disturbance or vibration occurs.

Figure 12:
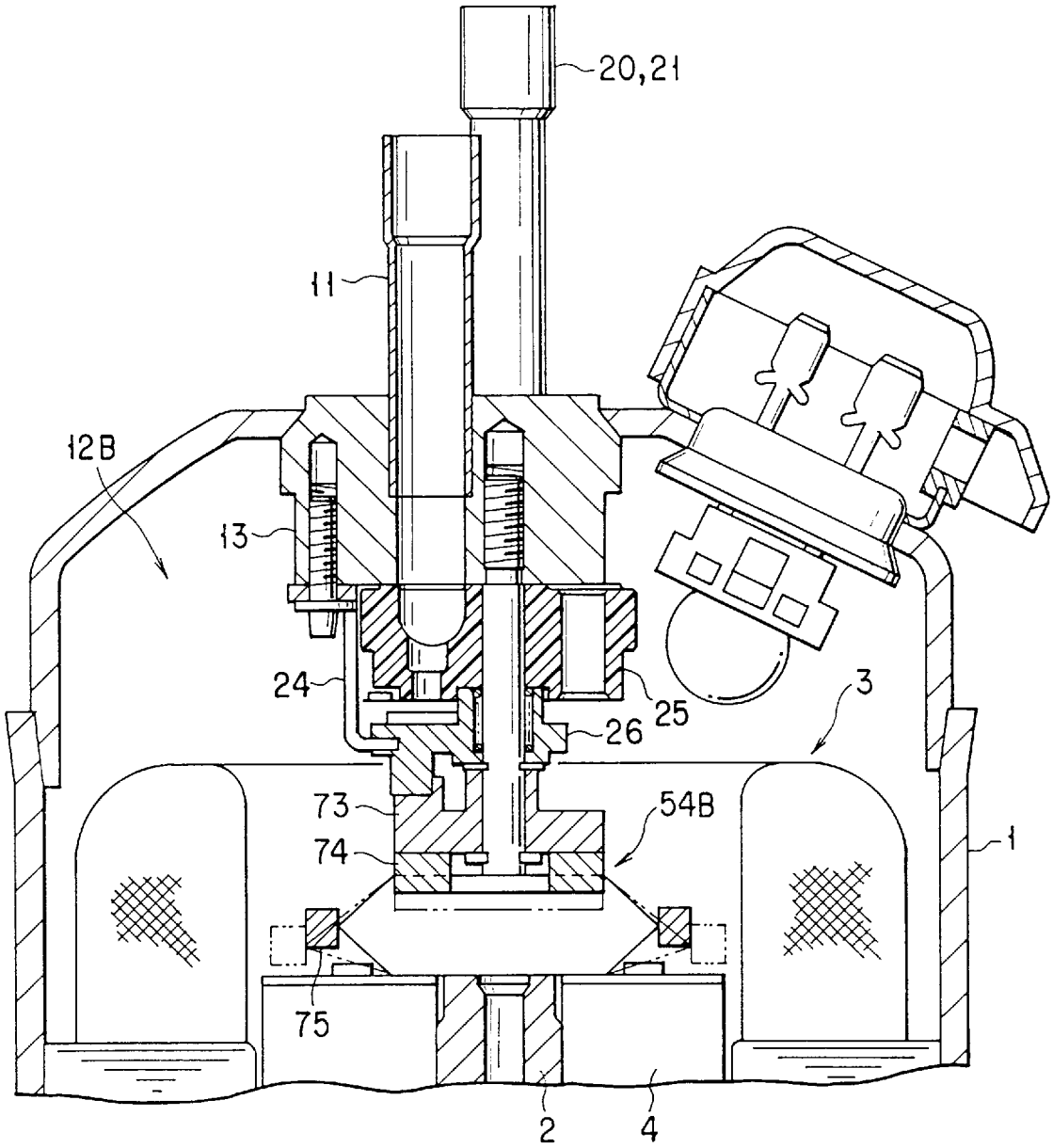
FIG. 12 is a vertical cross-sectional view showing a fluid compressor according to a fourth embodiment of the invention, with some parts being omitted.

FIG. 12 shows a fourth embodiment of the present invention wherein the magnetic coupling is replaced with clutch means 54B for directly driving the slider 25 by frictional force.

While the motor unit 3 is stopped, a first clutch 73 and a second clutch 74 constituting the clutch means 54B are coupled to each other and the clutch means 54B is set in the "coupled" state.

If the motor unit 3 is driven and the rotational speed of the rotor 4 increases to a predetermined level, the first clutch 73 is separated from the second clutch 74 by the action of the governor device 75 (a weight-like member is rotated and the clutches are separated from each other by the centrifugal force of the weight-like member). Thus, the clutch means 54B is set in the "separated" state.

Until the rotor 4 rotates several times, the rotational speed of the rotor 4 is low enough to maintain the coupling of the first and second clutches 73 and 74. Thus, the valve switching operation is performed by the combination of forward and reverse rotations of rotor 4, as in the preceding embodiments.

If the rotor 4 is rotated forwardly, the clutches 73 and 74 are separated from each other and the function of the switching valve 12B is neither adversely affected nor damaged.

If the motor unit 3 is controlled by the inverter 6, the rotational speed of the motor unit 3 can be freely controlled and a greater advantage is obtained.

In the above embodiments, the structure of the valve switching assembly is simplified by providing the slider 25 with the balance port 33 and first and second notches 36 and 37 serving as cams and by providing the pilot valve 43 with the driver 49 serving as cam drive device. However, these elements may be provided separately.

For example, the chamber 60 shown in FIG. 10 may be provided with a pilot valve and a balance port so that the high-pressure gas in the chamber may be discharged to the low-pressure atmosphere within the sealed casing 1.

Alternatively, the compressor mechanism unit may comprise balancer means, and the gas balance may be effected through the compressor mechanism unit when the operation of the compressor is stopped.

In the above embodiments, the switching valve 12 is applied to the fluid compressor A. However, the switching valve 12 may be applied to a pulse motor valve or an electronic automatic expansion valve widely used in air conditioning systems.

The pulse motor valve is characterized by the provision of a stepping motor. This valve can be rotated forwardly and reversely. If the pulse motor valve is provided with a pilot device having a gas balance function, the valve switching can be effected with a weak torque.

In the above embodiments, the present invention is applied to the use of four-way valves. It has been described that this invention is advantageous in multistage valve devices. However, this invention can be also applied to three-way valves and so-called unloader systems.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. A switching valve comprising:

a valve body to which a plurality of fluid passages are connected;

a slider having a gas passage capable of selectively connecting two of said plurality of fluid passages connected to the valve body;

a balance port formed in said slider to let said gas passage communicate with the outside of the slider;

a pilot valve for opening and closing said balance port;

a moving mechanism for moving said pilot valve and said slider in a predetermined direction; and forwardly and reversely rotatable driving means for driving said pilot valve, along with said moving mechanism, to open said balance port, thereby canceling a pressure difference between the inside and outside of the slider, and then moving the slider to switch said fluid passages.

2. A fluid compressor comprising:

a casing body to which a plurality of fluid passages are connected;

a compressor mechanism unit contained in said casing body;

a motor unit contained in said casing body and comprising a stator and a rotor; and a switching valve, contained in said casing body, for switching said fluid passages comprising:

a valve body to which said plurality of fluid passages are connected;

a slider having a gas passage capable of selectively connecting two of said plurality of fluid passages connected to the valve body;

a balance port formed in said slider to let said gas passage communicate with the outside of the slider;

a pilot valve for opening and closing said balance port;

a moving mechanism for moving said pilot valve and said slider in a predetermined direction; and a forwardly and reversely rotatable driving means for driving said pilot valve, along with said moving mechanism, to open said balance port, thereby canceling a pressure difference between the inside and outside of the slider, and then moving the slider to switch said fluid passages.

3. The fluid compressor according to claim 2, wherein said motor unit actuates the driving means of the switching valve, and includes magnetic coupling means provided between the motor unit and the moving mechanism, whereby said motor unit is magnetically coupled to the moving mechanism.

4. The fluid compressor according to claim 3, wherein said magnetic coupling means comprises a first magnet provided on said rotor of the motor unit, and a second magnet provided on said switching valve, said first and second magnets being situated in a non-contact state such that a torque can be transmitted between the first and second magnets.

5. The fluid compressor according to claim 4, wherein said first magnet is a non-magnetized magnetic material.

6. The fluid compressor according to claim 4, wherein said second magnet is a non-magnetized magnetic material.

7. The fluid compressor according to any one of claims 3, 4, 5 or 6, wherein the diameter of said magnetic coupling means is less than the inside diameter of a coil end of the stator of the motor unit, and said magnetic coupling means is situated inside the coil end.

8. The fluid compressor according to claim 2, wherein said pilot valve is formed of a material having resiliency in the thickness direction of the pilot valve.

9. The fluid compressor according to claim 2, wherein said moving mechanism comprises a tapered notch provided in said slider and a driver provided on said pilot valve so as to be engageable with the notch.

10. The fluid compressor according to claim 9, wherein when said driving means reversely rotates the slider, the driver of said moving mechanism is disengaged from the notch and the relative position of the slider to the pilot valve is shifted, thereby opening the balance port and canceling the pressure difference.

11. The fluid compressor according to claim 9, wherein when the driving means forwardly rotates the slider, the driver of the moving mechanism is engaged in said notch and moves the slider and the pilot valve in the same direction, and the pilot valve closes the balance port and switches the fluid passages.

12. The fluid compressor according to claim 9, wherein said moving mechanism has an idling function to prevent the driver from acting on the pilot valve, when the motor unit makes a single turn or less.

13. The fluid compressor according to claim 9, wherein said moving mechanism has an idling function for making the driving means and the slider separable and providing a play in the rotational direction thereof.

14. The fluid compressor according to claim 2, wherein said valve body has a stopper for limiting the rotation of the pilot valve when the motor unit reversely rotates the slider.

15. The fluid compressor according to claim 2, wherein said switching valve is controlled by control means for successively carrying out a first step of stopping the motor unit, a second step of reversely rotating the motor unit, and a third step of forwardly rotating the motor unit, thereby opening the balance port, canceling a pressure difference between the inside and outside of the slider, and then switching the fluid passages.

16. The fluid compressor according to claim 2, wherein the inside of said casing body is located outside the slider and defines a pressure space for a high-pressure fluid.

17. The fluid compressor according to claim 16, wherein said casing body is a sealed casing for temporarily collecting a high-pressure fluid compressed in the compressor mechanism unit.

18. The fluid compressor according to claim 2, further comprising:

an inverter to control the rotations of said motor unit.

19. The fluid compressor according to claim 2, wherein said slider is resiliently urged onto the valve body by means of a resilient member.

20. The fluid compressor according to claim 2, wherein said driving means transmits a driving force to said slider via a clutch means, and wherein said clutch means is set in a separated state when the number of rotations per minute of the motor unit reaches a predetermined value.

21. A fluid compressor comprising:

a casing body to which a plurality of fluid passages are connected;

a motor unit including a compressor mechanism unit, a stator and a rotor all contained in said casing body;

a switching valve, contained in said casing body and connected to said fluid passages, for selectively connecting two of said plurality of fluid passages; and magnetic coupling means, provided between said switching valve and said motor unit, for magnetically coupling the switching valve and the motor unit, thereby transmitting a driving force of the motor unit to the switching valve.

22. The fluid compressor according to claim 21, wherein said magnetic coupling means comprises a first magnetic material formed on the rotor of the motor unit and a second magnetic material formed on the switching valve, at least one of said first and second magnetic materials being magnetized into a magnet, and a torque can be transmitted between said first and second magnetic materials in a non-contact state.

23. A heat pump type refrigeration cycle comprising:

a casing body to which a plurality of fluid passages are connected;

a fluid compressor for compressing a fluid contained in said casing body;

a switching valve contained in said casing body for switching fluid passages in said fluid compressor for flowing a non-compressed low pressure fluid and a compressed high pressure fluid comprising:

a valve body to which a plurality of fluid passages are connected;

a slider having a gas passage capable of selectively connecting two of said plurality of fluid passages connected to the valve body;

a balance port formed in said slider to let said gas passage communicate with the outside of the slider; a pilot valve for opening and closing said balance port;

a moving mechanism for moving said pilot valve and said slider in a predetermined direction; and forwardly and reversely rotatable driving means for driving said pilot valve, along with said moving mechanism, to open said balance port, thereby canceling a pressure difference between the inside and outside of the slider, and then moving the slider to switch said fluid passages;

an indoor heat exchanger and an outdoor heat exchanger connected to said switching valve via pipes; and a restriction device provided between the indoor heat exchanger and the outdoor heat exchanger having a variable opening.

24. The heat pump refrigeration cycle according to claim 23, wherein said fluid compressor is driven for a period of time before said switching valve is driven.

25. The heat pump type refrigeration cycle according to claim 23, wherein the degree of opening of the restriction device is increased prior to the switching operation of the switching valve, thereby balancing the high-pressure side pressure and the low-pressure side pressure.

26. The heat pump type refrigeration cycle according to claim 23, wherein the switching operation of said switching valve is monitored by monitor means.

27. The heat pump type refrigeration cycle according to claim 26, wherein said switching valve includes control means for issuing a switching operation start command once again, when said monitor means has found an error in the switching operation of the switching valve.

28. The heat pump type refrigeration cycle according to claim 26, wherein said monitor means is one of a temperature sensor and a pressure sensor provided on at least one of a section in said fluid compressor containing high pressure fluids and a section containing low pressure fluids.

* * * * *